US005520237A

United States Patent [19]

Finkelstein et al.

[11] Patent Number: 5,520,237

[45] Date of Patent: May 28, 1996

[54] STRIP CURTAIN SYSTEM

[75] Inventors: Burl Finkelstein, Newnan; Thomas A. Thorsen, Moreland, both of Ga.; Larry Crabtree, Kansas City, Mo.

[73] Assignee: Kason Industries, Inc., Shenandoah, Ga.

[21] Appl. No.: 313,783

[22] Filed: Sep. 28, 1994

[51] Int. Cl.[6] ..... E05D 15/00

[52] U.S. Cl. ..... 160/184; 160/332

[58] Field of Search ..... 160/184, 332, 160/380, 345, 196.1; 312/116

[56] References Cited

U.S. PATENT DOCUMENTS

| | | | |
|---|---|---|---|
| 3,809,144 | 5/1974 | Garufo | 160/184 |
| 4,289,190 | 9/1981 | Catan | 160/184 X |
| 4,312,396 | 1/1982 | McKinnon et al. | 160/184 X |
| 4,335,777 | 6/1982 | Simon | 160/184 X |
| 4,449,270 | 5/1984 | Brabant | 160/332 X |
| 4,515,202 | 5/1985 | Wilson | 160/332 |
| 5,127,460 | 7/1992 | Abadi et al. | 160/184 X |
| 5,146,971 | 9/1992 | McCarty | 160/184 |

FOREIGN PATENT DOCUMENTS

| | | | |
|---|---|---|---|
| 1229987 | 9/1960 | France | 160/332 |
| 2054712 | 2/1981 | United Kingdom | 160/332 |

*Primary Examiner*—Blair Johnson

[57] ABSTRACT

A strip curtain system having an elongated track adapted to be mounted over a doorway and having two spaced apart rails, a plurality of curtain strips and a plurality of hangers. Each curtain strip has a top end portion and a main body portion. The top end portion has at least one hole therethrough and a width less than the width of the main body portions. Each hanger has a male plate with at least one peg and a female plate with at least one hole sized to receive the male plate peg. A strip curtain may be assembled in the doorway by mounting the track thereabove, mounting the hangers to the top end portions of the strips, and sliding the hangers upon the track into abutment with one another with only the main bodies of adjacent strips suspended therefrom overlaying one another beneath the track.

10 Claims, 3 Drawing Sheets

STRIP CURTAIN SYSTEM

TECHNICAL FIELD

The present invention relates generally to strip curtains, and more particularly to strip curtains of the type having tracks for sliding individual strips thereon for curtain erection and repair.

BACKGROUND OF THE INVENTION

Strip curtains are typically used to limit or prevent the flow of air, moisture and vermin through doorways while allowing ease of passage in and out by individuals. Doorways that typically utilize strip curtains for these purposes are walk-in coolers and freezers, refrigerated and nonrefrigerated warehouses, factory doors, loading docks, and refrigerated trucks. These strip curtains, which are typically made of plastic such as fire resistant vinyl, may also be used as barriers for sound control, shielding welding light, containment of chips and coolant spray from machining processes, and control of dust migration during construction projects.

Strip curtains typically have a mounting system from which an array of strips are suspended. The mounting systems are designed such that the strips are secured at their top ends in tandem, yet easily replaceable if worn or damaged. Adjacent strips should be mounted to overlap, but without significant bulging for an efficient doorway seal. The mounting system should be relatively easy to install, accommodate variously sized strips, and be aesthetically pleasing.

One known strip curtain, which accommodates varying sizes of strips, utilizes a frame element clamped onto a cover element by screws to secure strips in place therebetween. Screws are provided for mounting the frame to a door frame or jam. The strips have supports secured to their upper ends, which mount into channels of the frame and the cover element prior to the cover being clamped in place. The supports have downward hook portions which rest in the channel. These strips, however, must be carefully handled during installation so that the supports do not separate from the channels. In order to replace damaged strips the entire cover element must be completely removed from the frame element. Aesthetically detracting is the bulkiness of the combined frame and cover elements with both sets of screws being visible.

Another type of strip curtain is an end loading type, which allows for loading and unloading of the strips without having to remove an entire mounting structure such as the aforementioned cover from a doorway. However, in end loading strip curtains the strips often bunch together within their mount creating nonuniform spacing along the length of the curtain. This particular problem has been solved by interconnecting the entire array of strips together prior to their being end loaded. However, with the entire curtain so assembled, replacement of as little as a single strip is difficult and tedious. Other prior art strip curtains have not been versatile in that the amount of strip overlapping has been difficult to adjust. Another problem has been the inability for some strips to be cut off of rolls, while others have also had to have the ends heat sealed.

Thus, there exists a need for an improved strip curtain which is accommodates various strip sizes, which provides for easy replacement of strips, and which is aesthetically pleasing. Accordingly, it is to the provision of such that the present invention is primarily directed.

SUMMARY OF THE INVENTION

In a preferred form of the invention, a strip curtain system has an elongated track adapted to be mounted over a doorway which has two spaced apart rails. The system also has a plurality of curtain strips with each curtain strip having a top end portion and a main body portion. The top end portion of each strip has at least one hole therethrough and a width less than the width of the main body portion. A plurality of hangers is also provided with each hanger having a male plate with at least one peg and a female plate with at least one hole sized to receive the male plate peg. So constructed, the strip curtain may be assembled in the doorway by mounting the track thereabove, mounting the hangers to the top end portions of the strips, and sliding the hangers upon the track into abutment with one another with only the main bodies of adjacent strips suspended therefrom overlaying one another beneath the track.

In another preferred form of the invention a strip curtain system comprises a track with an elongated slot of a selected width, a plurality of strips, and a plurality of hangers with each hanger mounted to a top end portion of each strip. Each hanger has two plates and means for mounting the plates together with a strip sandwiched therebetween. The two plates have a combined width, which combined with the thickness of a strip, is greater than the slot width for sliding movement along the track with the strip extending through the slot.

DETAILED DESCRIPTION OF THE INVENTION

Figure 1:
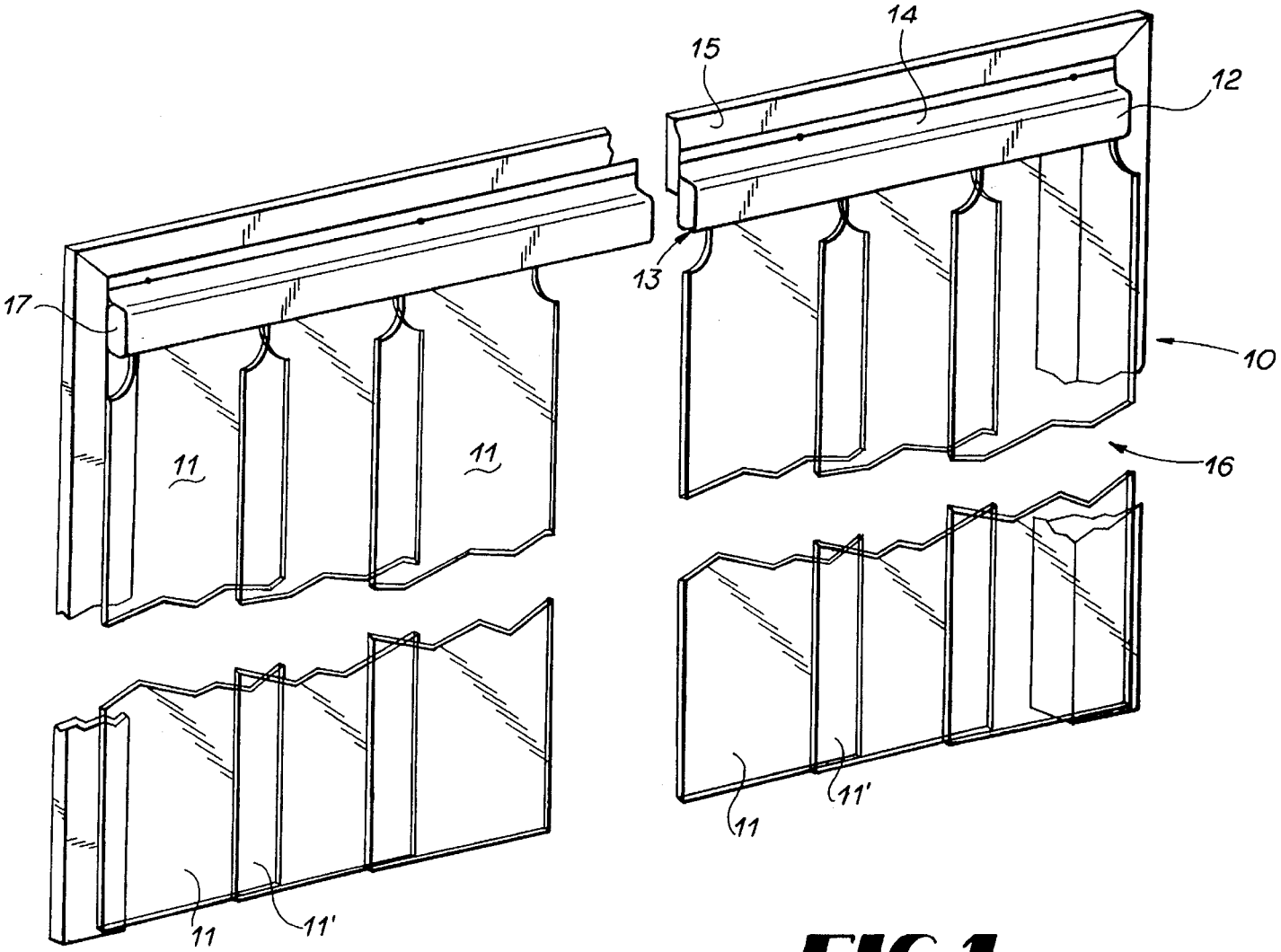
FIG. 1 is a perspective view of a portion of a strip curtain embodying principles of the invention in a preferred form.

Referring now in more detail to the drawings in which like numerals indicate like parts, FIG. 1 illustrates a strip curtain 10 having strips 11 which overlap in areas 11' and which are slidably mounted to a channel 12 through an elongated slot 13 that extends along the bottom of the channel 12. The channel 12 has a flange 14 which is mounted to a door frame 15 about a doorway 16. Both ends of the channel 12 are sealed by end caps 17.

Figure 2:
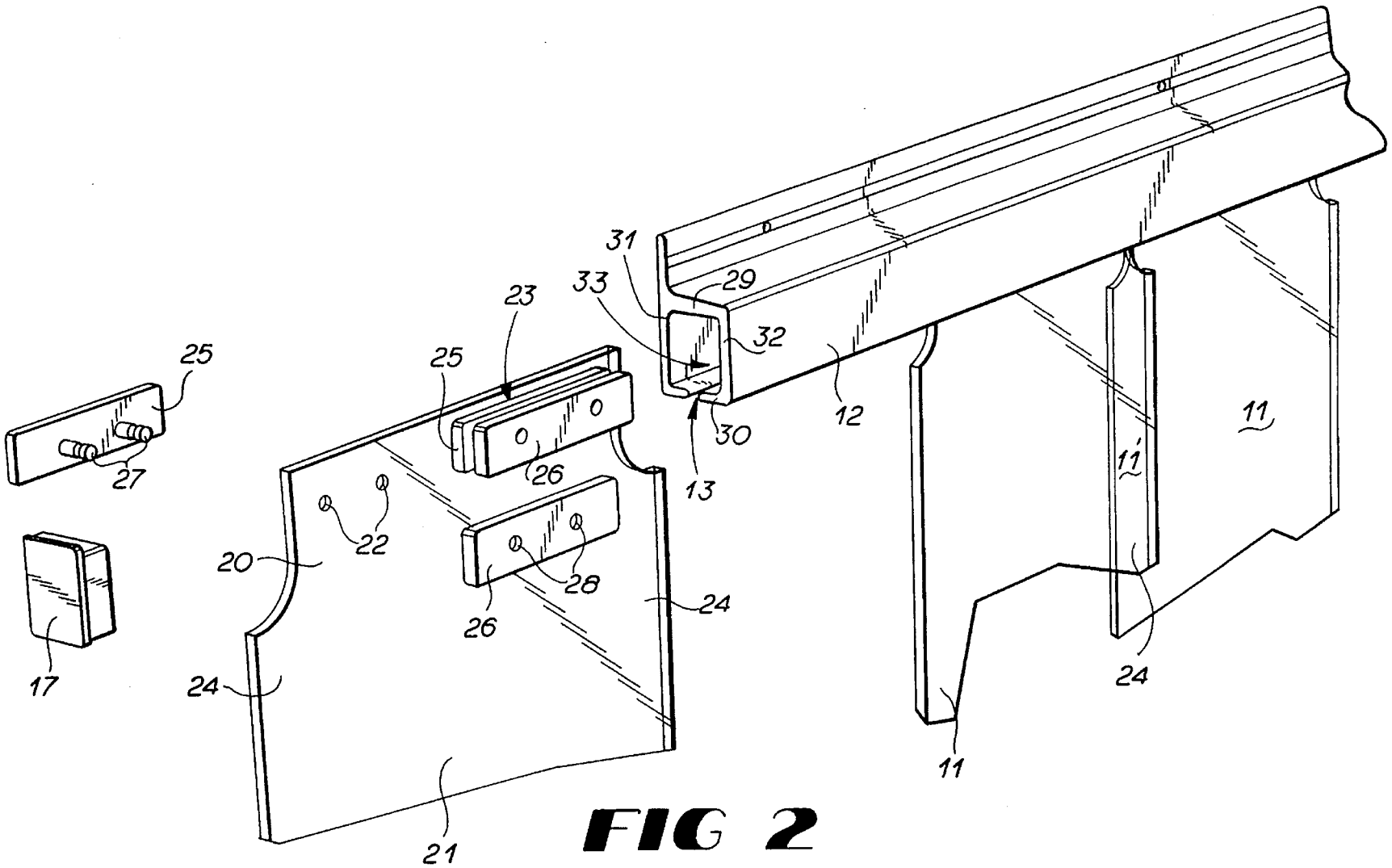
FIG. 2 is an exploded view of a portion of the strip curtain of FIG. 1.

Each strip 11, as shown in more detail in FIG. 2, has a top end portion 20 formed with holes 22 for mounting the strip 11 to a hanger 23. The top end portion 20 extends below the holes 22 sufficiently to clear the elongated slot 13 of the channel 12 when mounted thereto. The top end portion 20 has a width less than that of the main body portion 21 of the strip 11. The main body portion 21 has wings or flap portions 24 on each side which are defined by the portion of the width of the main body portion 21 that extends beyond the width of the top end portion 20. The flap portions 24 of adjacent strips overlap forming the overlap areas 11'.

Each hanger 23 has a cleat or male bar or plate 25 and a cover or female bar or plate 26. The male plate 25 has two spaced apart pegs 27 and the female plate 26 has two respectively spaced apart holes 28. The pegs 27 are grooved at one end for snap engagement with the holes 28. Each strip 11 is mounted to the hanger 23 by inserting the pegs 27 through the strip holes 22 and into the holes 28 of the female plate 26 thereby sandwiching the strip 11 between the two plates of the hanger.

The channel 12 has a top wall 29, a bifurcated bottom wall 30, and two opposing side walls 31 and 32. The slot 13 in the bottom wall 30 has a width less than the combined thickness of the plates 25/26 and the strip 11, yet greater than the thickness of the strip 11 alone. The channel 12 thus provides a track with its bottom wall 30 providing two spaced-apart side rails upon which the hangers 23 may slide. The bore 33 of the channel 12 is of a size sufficient to receive the hangers 23 with strips 11 mounted thereto to permit sliding, longitudinal movement of the hanger 23, yet limit transverse movement.

Figure 3:
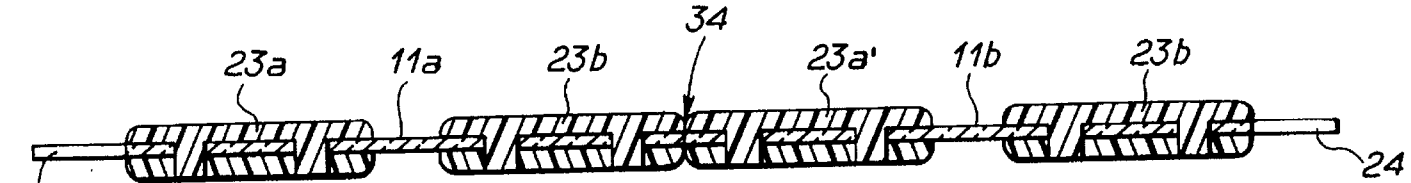
FIG. 3 is a cross-sectional, top view of a portion of the strip curtain of FIG. 1.
Figure 4:
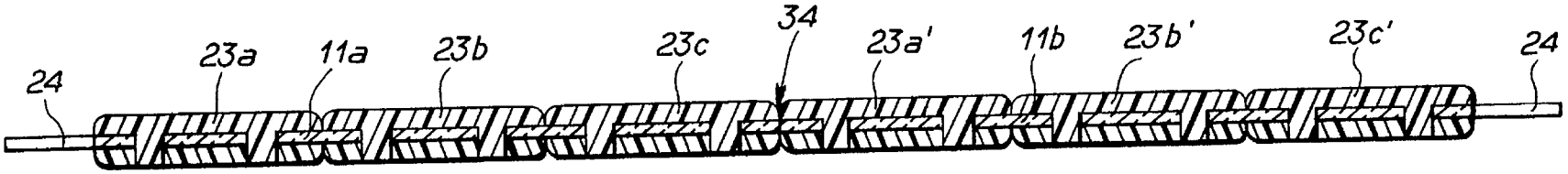
FIG. 4 is a cross-sectional, top view of a portion of a strip curtain embodying principles of the invention in another preferred form.
Figure 5:
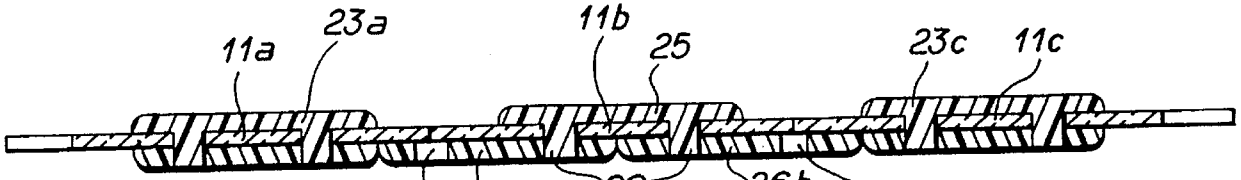
FIG. 5 is a cross-sectional, top view of a portion of a strip curtain embodying principles of the invention in still another preferred form.

The strip curtain 10 may have variously sized strips and strip overlaps as shown in FIGS. 3–5. In FIG. 3, the strip curtain 10 of FIGS. 1 and 2 is illustrated. In this particular embodiment, the top end portions 20 are about 4½ inches wide with four holes 22 positioned to receive the pegs 27 of the two male plates 25. The main body portion 21 of the strips 11 are about 6 inches wide with the flap portions 24 each being about three quarters of an inch wide. The hangers 23 are about 2 inches in width.

A strip 11*a* is shown adjacent a strip 11*b* with their top end portions 20 abutting each other at a point 34. The strip 11*a* has a hanger 23*a* and a hanger 23*b* mounted to its top end portion 20 about a ½ inch apart. Similarly, the strip 11*b* has a hanger 23*a*' and a hanger 23*b*' mounted thereto. The hangers of the adjacent strips 11*a* and 11*b* are positioned such that hanger 23*b* of strip 11*a* abuts hanger 23*a*' of strip 11*b* also at the point 34. Upon abutting adjacent strips 11*a* and 11*b*, their adjacent flaps 24 overlap each other in the area 11' below the channel 12. The overlap area 11', created by the adjacent flaps 24, is approximately 1½ half inches on each side, thereby providing about fifty percent coverage of the width of the main body portion 21.

The hangers 23*a* and 23*b* are spaced apart such that their side edges are flush with the side edges of the strip top end portions 20. This prevents overlap of the strips 11 from occurring within the channel 12. With adjacent strips 11 being linearly aligned within the channel 12 and transverse movement of the hangers 23 restricted therein, and with the top end portions 20 so prevented from overlapping, any bulging is minimized which is a problem no longer associated with the prior art.

In FIG. 4 two adjacent, abutting strips 11*a* and 11*b* each have a top end portion 20 with about a 6 inch width and a main body portion 21 with about an 8 inch width. Both strips 11*a* and 11*b* have six holes 22 to receive the pegs 27 of the three male plate 25. Three hangers 23*a*, 23*b*, and 23*c* of the same size as those of FIG. 3 are mounted on each of adjacent strips 11*a* and 11*b* and encase the entire width of the top end portions 20. Thus, adjacent side edges of the top end portions 20 of the strips 11*a* and 11*b* are flush with adjacent side edges of hangers 23*c* and 23*a*' such that both the adjacent hangers and adjacent strips abut each other at point 34. The overlap of the flaps 24 below the point 34 created by this arrangement is approximately 2 inches, providing about a fifty percent overlap of the width of the main body portion 21.

In FIG. 5 adjacent strips 11*a*, 11*b*, and 11*c* each have about a 4 inch wide main body portion 21 including flaps 24 being about ½ inch wide and have about a 3 inch wide top end portion 20 with two holes 22 to receive the pegs 27 of a male plate 25. The hanger 23 are the same size as those of FIG. 3. However, due to the width of the top end portion 20, the hanger 23 may not be positioned with both its edges flush with the edges of the top end portion 20 for abutting adjacent strips 11. Thus, a special configuration of the hangers 23 is employed in order for adjacent strips 11 to abut at their top end portions 20 within the channel 12.

The outer strips 11*a* and 11*c* each have one hanger 23*a* and 23*c* centrally mounted at their top end portions 20. Mounted to the inner strip 11*b*, which lies between the outer strips 11*a* and 11*c*, are two adjacent female plates 26*a* and 26*b* located on one side of the strip 11*b* and one male plate 25 located on the opposing side of the strip 11*b*. The female plates 26*a* and 26*b* abut one another at about the midpoint of the inner strip 11*b* and are mounted to the male plate 25 with their adjacent holes 28 each engaged to one of the pegs 27 of the male plate 25. The distal holes 28' are not engaged with any pegs. When mounted within the chamber 12, one of the female plates 26*a* of the inner strip 11*b* abuts the hanger 23*a* of one of the outer strips 11*a* and the other female plate 26*b* abuts the hanger 23*b* of the other outer strip 11*c*. This configuration prevents adjacent strips 11 from overlapping within the chamber 12 and allows for about a fifty percent overlap of the width of the main body portion 21.

The strip curtain 10 described above is versatile in that it may be easily customized to desired overlaps since the hangers 23 may accommodate different strip sizes by merely adding more hangers to the strips 11 or alternating the configuration of the hangers on the strips. The strips curtain 10 is also easy to install by simply screwing the channel 12 onto a door frame along the flange 14. The strips 11 may be mounted within the channel 12 either before or after mounting of the channel 12. The strips 11 are easily mounted to the channel 12 by sliding the hangers 23 along the slot 13 with consistent percentages of strip overlay created across an entire doorway. The strips 11 may be removed from the channel 12 for replacement also with ease by simply removing an end cap 17 and sliding the hangers 23 along the slot 13 to exit one end of the channel 12.

While this invention has been described in detail with particular references to preferred embodiments thereof, it should be understood that many modifications, additions and deletions may be made thereto without departure from the spirit and scope of the invention as set forth in the following claims.

We claim:

1. The strip curtain system, comprising, in combination:

an elongated track adapted to be mounted over a doorway and having two generally horizontally spaced apart rails;

a plurality of curtain strips each having a top end portion and a main body portion, said top end portion having at least one hole therethrough and a width less than the width of said main body portions, and a plurality of hangers each having a male plate with at least one peg and a female plate with at least one hole sized to receive said male plate peg, said male plate being supported upon one said rail and said female plate being supported upon the other said rail, whereby a strip curtain may be assembled in the doorway by mounting the track thereabove, mounting the hangers to the top end portions of the strips, and sliding the hangers upon the track serially into abutment with one another with only the main bodies of adjacent strips suspended therefrom overlaying one another beneath the track.

2. The strip curtain system of claim 1 wherein a plurality of said hangers are mounted to each of said curtain strips.

3. The strip curtain system of claim 1 wherein said hangers are of identical size and shape.

4. The strip curtain system of claim 1 wherein said curtain strips are of identical size and shape.

5. The strip curtain system of claim 1 wherein said female plates of said hangers have two holes, and said male plates of said hangers have two pegs.

6. A strip curtain system, comprising, in combination:

a track having two generally horizontally opposed rails defining an elongated slot therebetween of a selected width, a plurality of strips, a plurality of hangers with each hanger mounted to a top end portion of each strip, said hangers each having two plates and means for mounting said plates together with a strip sandwiched therebetween, and said two plates having a combined width which combined with the thickness of said strip is greater than said selected width of said slot for sliding movement of one said plate upon one said rail and the other said plate upon the other said rail with said strip extending through said slot.

7. The strip curtain system of claim 6 wherein a plurality of said hangers are mounted to each of said curtain strips.

8. The strip curtain system of claim 6 wherein said hangers are of identical size and shape.

9. The strip curtain system of claim 6 wherein said curtain strips are of identical size and shape.

10. The strip curtain system of claim 6 wherein one said plates of said hangers have two holes, and the other said plates of said hangers have two pegs.

* * * * *